US009222663B1

(12) United States Patent
Yang

(10) Patent No.: US 9,222,663 B1
(45) Date of Patent: Dec. 29, 2015

(54) WATER LAMP WITH TOP DECORATION

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 5 days.

(21) Appl. No.: 14/318,697

(22) Filed: Jun. 30, 2014

(51) Int. Cl.
*F21V 31/04* (2006.01)
*F21V 23/00* (2015.01)

(52) U.S. Cl.
CPC ..... *F21V 31/04* (2013.01); *F21V 23/005* (2013.01)

(58) Field of Classification Search
CPC ..... F21V 31/04; F21V 23/005
See application file for complete search history.

(56) References Cited

U.S. PATENT DOCUMENTS 6,065,850 A * 5/2000 Chiu ..... 362/101
6,135,604 A * 10/2000 Lin ..... 362/101
6,375,337 B1 * 4/2002 Hwang ..... 362/101
6,416,197 B1 * 7/2002 Chang ..... 362/96
2002/0176246 A1 * 11/2002 Chen ..... 362/101
2014/0268660 A1 * 9/2014 Yang ..... 362/101
2014/0268667 A1 * 9/2014 Yang ..... 362/101
2014/0268668 A1 * 9/2014 Yang ..... 362/101
2014/0268671 A1 * 9/2014 Yang ..... 362/101

* cited by examiner

*Primary Examiner* — Mary Ellen Bowman
(74) *Attorney, Agent, or Firm* — Leong C. Lei

(57) ABSTRACT

A water lamp with a top decoration mainly includes a main body, base seat and top decoration. The main body is hollow and pervious to light, and slightly-thick, flowable low-boiling point fluid is filled hermetically and a poking member are mounted inside the main body; the base seat is configured below the main body, and a control circuit and at least one light-emitting element in electric connection with the control circuit are configured on the base seat correspondingly to the bottom of the main body, and a magnetic rotating shaft attracting the poking member magnetically to rotate is further configured on the base seat; the top decoration assumes a foggy, pervious-to-light, three-dimensional modeling, coupled to the upper side of the mainbody, a light-emitting element in electric connection with the control circuit being configured inside the top decoration. Whereby, the low-boiling-point fluid inside the water lamp will flow due to the heat generated from the light-emitting element when the base seat is switched on, and light further penetrates the top decoration, allowing the present invention to achieve both lighting and dynamic visual effects at the same time.

3 Claims, 6 Drawing Sheets

WATER LAMP WITH TOP DECORATION

(A) TECHNICAL FIELD OF THE INVENTION

The present invention relates to a water lamp decoration, and more particularly to a structure with a double effect of lighting and dynamics.

(B) DESCRIPTION OF THE PRIOR ART

Decorative lighting may always be seen in living rooms, bed rooms of a house besides illumination lamps. However, such kinds of decorative lights are mainly used for illumination of a small portion of partial space or embellishment to enhance environmental atmosphere. However, all of such kinds of decorations are static embellishments only. Therefore, a water lamp, inside which paillettes, light-colored powder or the like, is developed; the paillettes, light-colored powder or the like inside thereof are stirred by means of manual upside-down shaking or electric power to generate visual perceptions of fluid motion to people, and different visual effects due to different objects inside the water lamps, allowing the water lamps to have a expandable space, and extensible, various visual change effects, or even have multi-functional, interesting developments. But, the water lamp mentioned above can be further designed and changed only in a water ball portion such that the development thereof is restrained. Therefore, if the water ball light can be added with other elements with interesting functions or breakthrough appearance visual effects, it will be welcome by people for sure.

SUMMARY OF THE INVENTION

The main object of the present invention is to add a water lamp decoration with visual perception to people.

Thus, the present invention proposes a water lamp with a top decoration, including: a main body, assuming a hollow and pervious-to-light three-dimensional modeling, and slightly-thick, flowable low-boiling point fluid and a poking member are mounted inside the main body hermetically; a base seat, configured below the main body, and a control circuit and at least one light-emitting element in electric connection with the control circuit being configured on the base seat correspondingly to a bottom of the main body, and a magnetic rotating shaft attracting the poking member magnetically to rotate being further configured on the base seat; and a top decoration, assuming a foggy, pervious-to-light, three-dimensional modeling, coupled to a upper side of the main body, a light-emitting element in electric connection with the control circuit being configured inside the top decoration. Whereby, the low-boiling-point fluid inside the water lamp will flow due to the heat generated from the light-emitting element when the base seat is switched on, and light further penetrates the top decoration, allowing the present invention to achieve both lighting and dynamic visual effects at the same time.

DETAILED DESCRIPTION OF THE PREFERRED EMBODIMENTS

Figure 1:
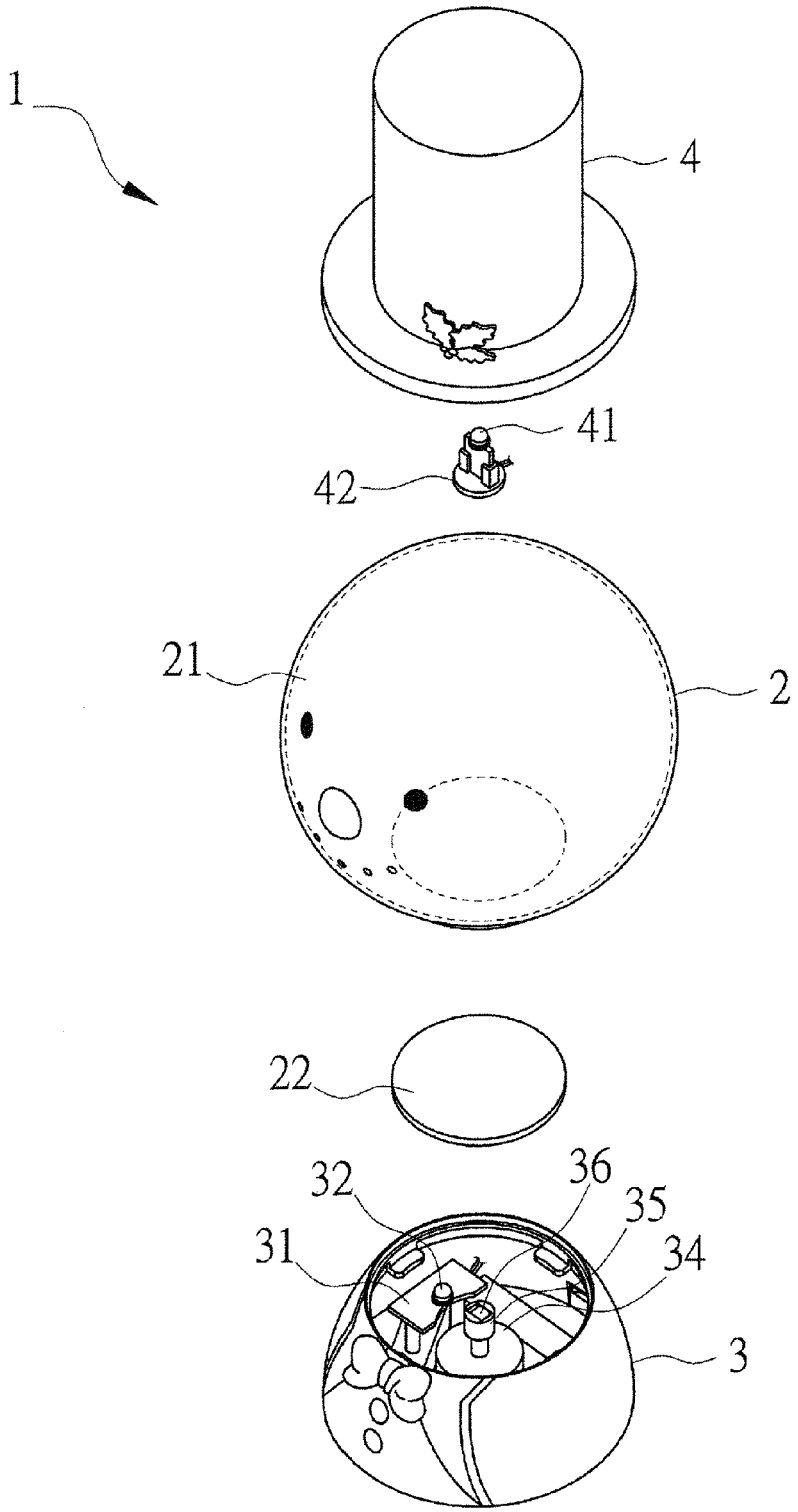
FIG. 1 is an exploded view of a water lamp with a top decoration of a preferred embodiment according to the present invention.
Figure 2:
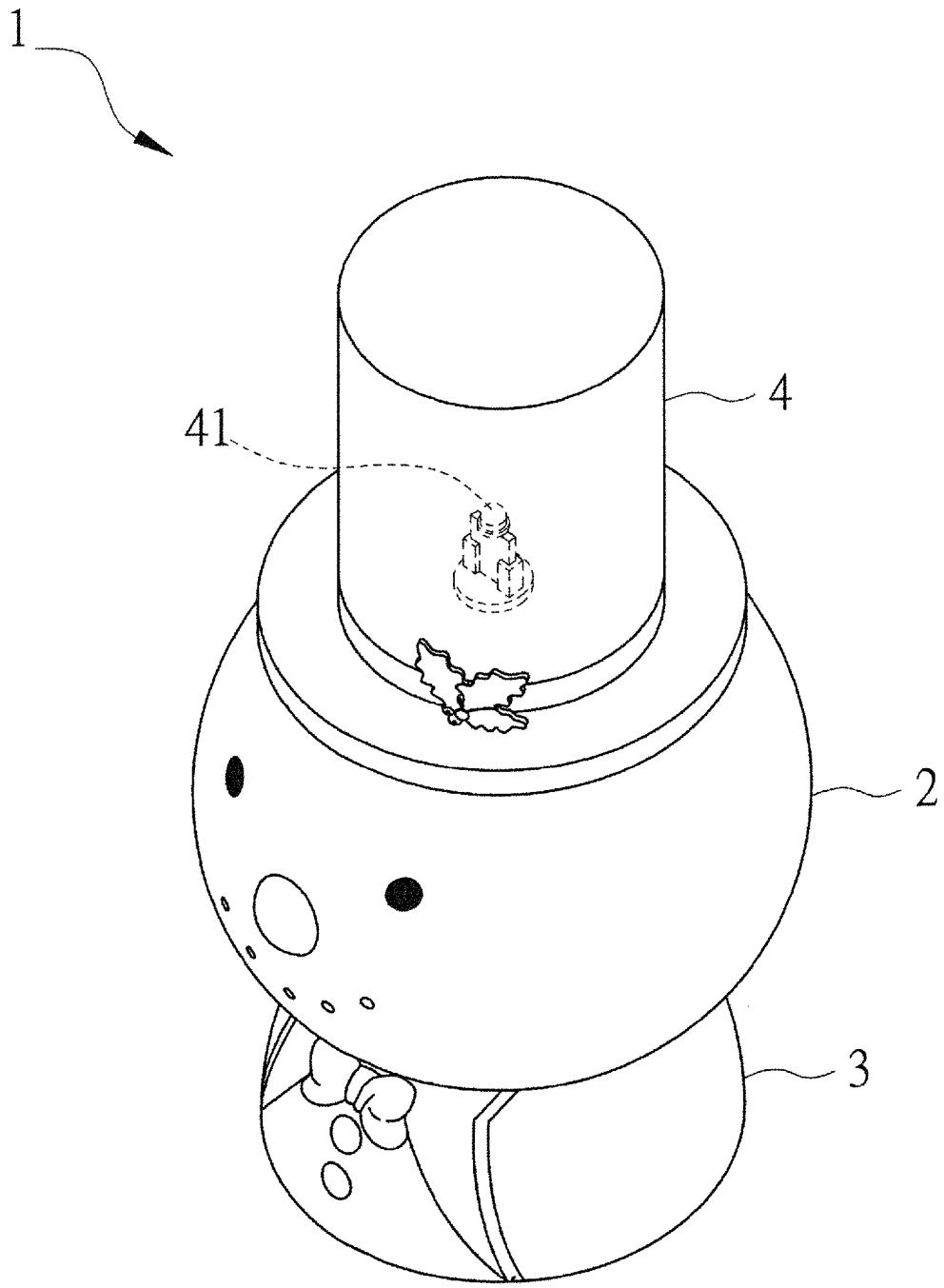
FIG. 2 is a perspective view of the water lamp of the embodiment according to the present invention.
Figure 3:
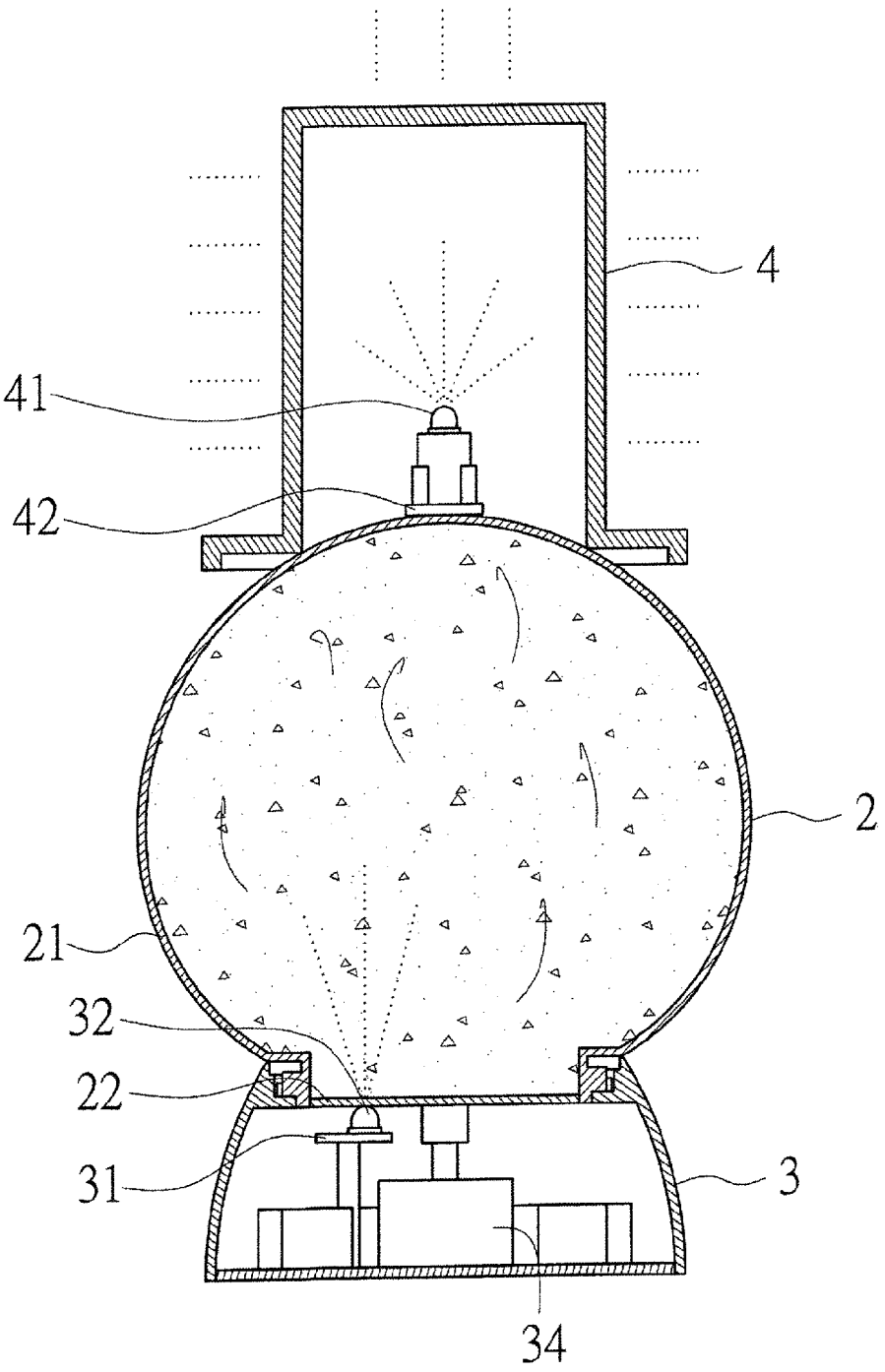
FIG. 3 is a cross-sectional view of the water lamp of the embodiment according to the present invention.
Figure 4:
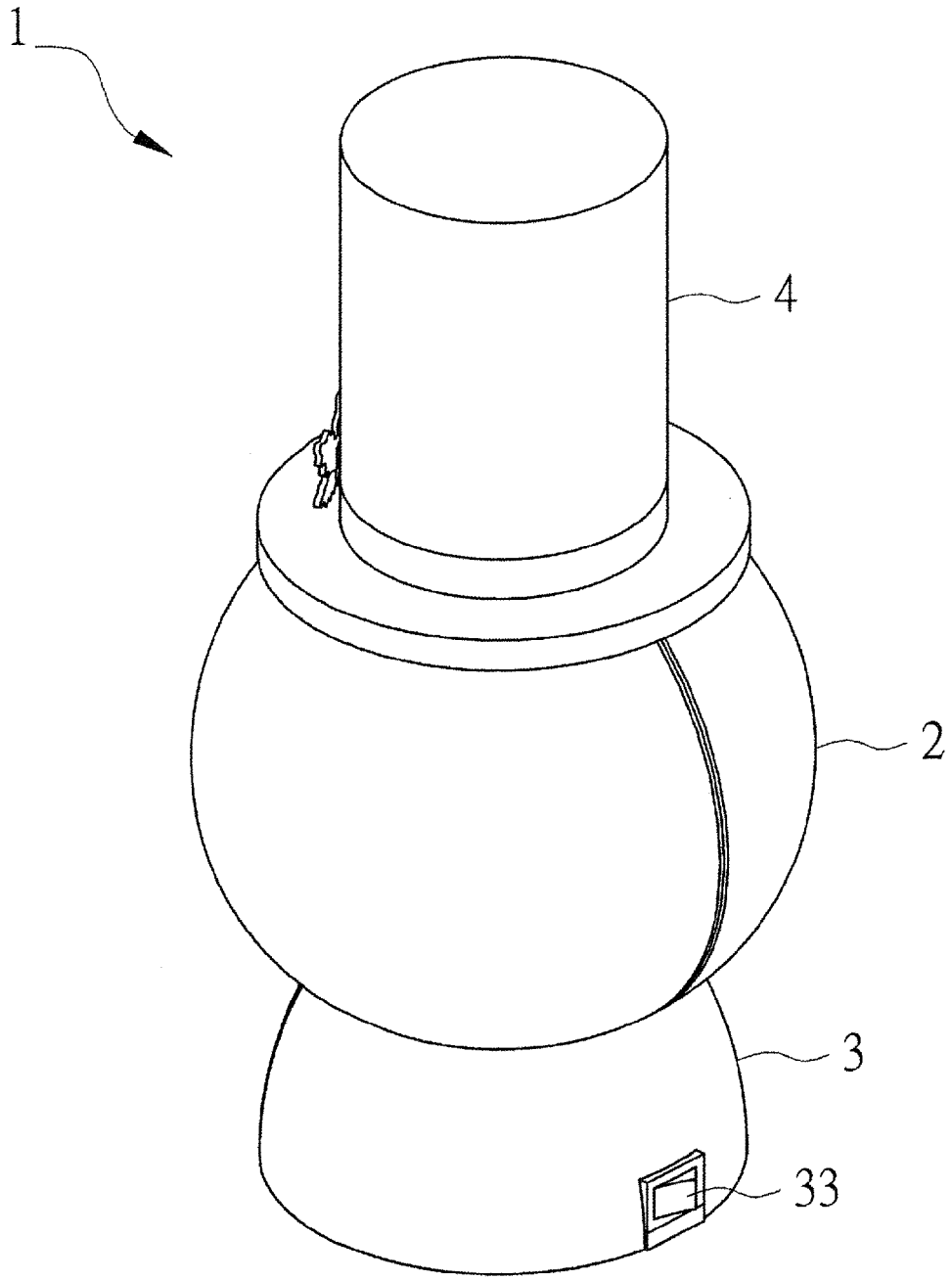
FIG. 4 is a perspective view of the water lamp of the embodiment according to the present invention while seeing from a rear side thereof.

Referring to FIGS. 1 to 4, which respectively are exploded, perspective, cross-sectional and perspective views of a preferred embodiment of a water lamp with a top decoration according to the present invention, a water lamp 1 mainly includes a main body 2, a base seat 3 and a top decoration 4, where the main body 2 is configured above the base seat 3, and the top decoration 4 above the main body 2.

The main body 2 assumes a hollow, pervious-to-light, three-dimensional modeling, constituted by a shell 21 and a bottom cover 22. Furthermore, slightly-thick flowable low-boiling-point fluid is filled hermetically and paillettes or light-colored powder is added inside the main body 2. In the present embodiment, the main body 2 is spherical, and the surface thereof is drawn with a facial-features pattern, allowing the present invention to form a human face modeling. Bur, the present invention is not limited to the appearance and modeling mentioned above.

The base seat 3 is configured below the main body 2, and a control circuit 31, light-emitting element 32 and switch 33 are configured thereon correspondingly to the bottom cover 22 of the main body 2, where the light-emitting element 32 and switch 33 are in electric connection with the control circuit 31, and the control circuit 31 is adapted to control the glistening frequency and light color change of the light-emitting element 32. In the present invention, the number of the light-emitting elements 32, for convenient explanation, is one, but it can be changed (increased) depending on the dimension of the main body 2.

The top decoration 4 assumes a foggy pervious-to-light three-dimension modeling, being in connection with the upper side of the main body 2, where a light-emitting element 41 in connection with the control circuit 31 is configured inside the top decoration 4, where the light-emitting element 41 is fixed on the top of the main body 2 through a fixing member 42, and the control circuit 31 controls the glistening frequency and light color change of the light-emitting element 41.

Thereupon, not only the flowing of the low-boiling-point fluid inside the main body 2 is caused due to the heat generated from the light-emitting element 32 when the electric conduction between the base seat 3 and a power source is provided, but the top decoration 4 is pervious to light, allowing the present invention to achieve a double visual effect of lighting and dynamics.

Figure 5:
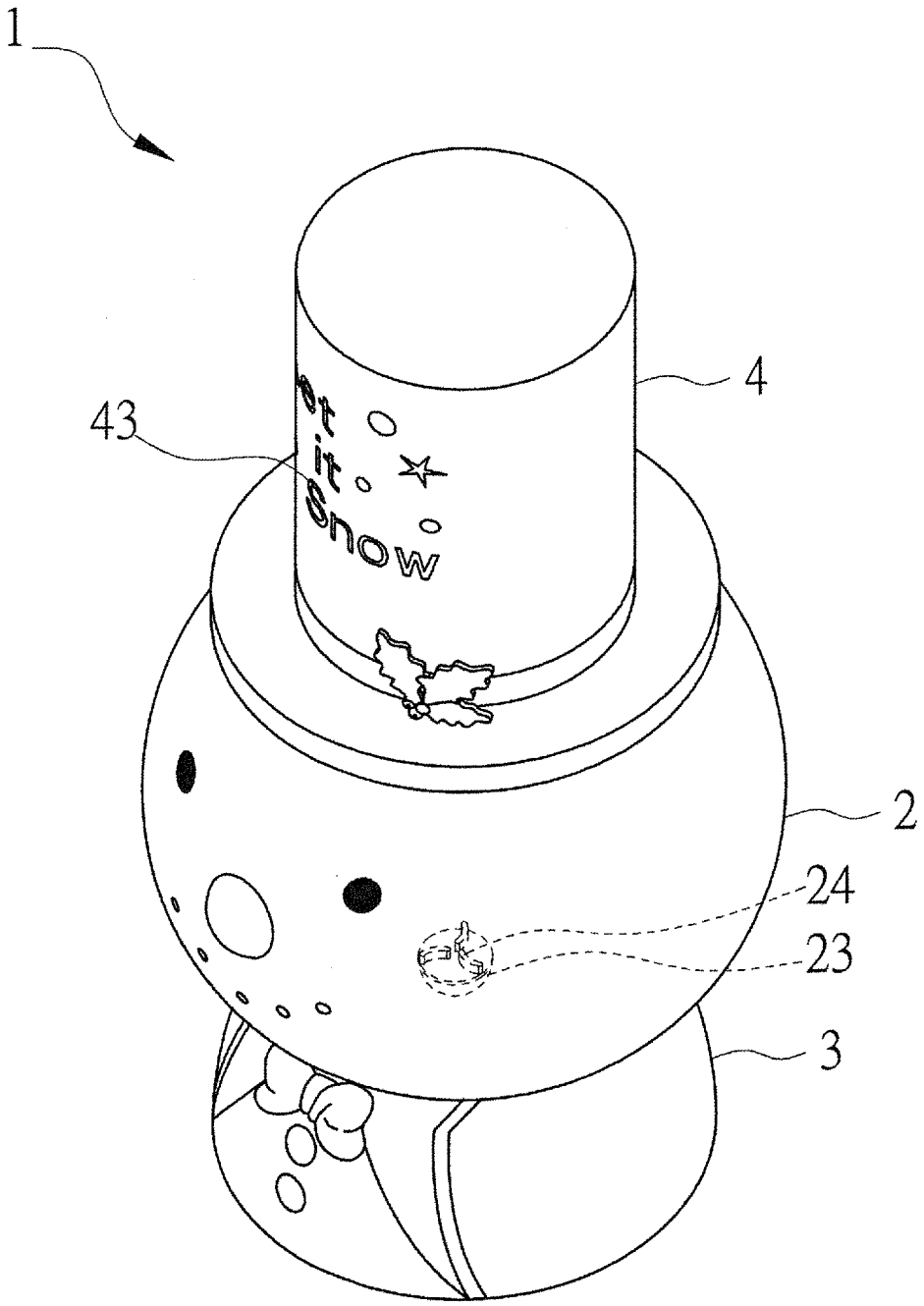
FIG. 5 is a perspective view of the water lamp of the embodiment according to the present invention in which a poking member is configured.
Figure 6:
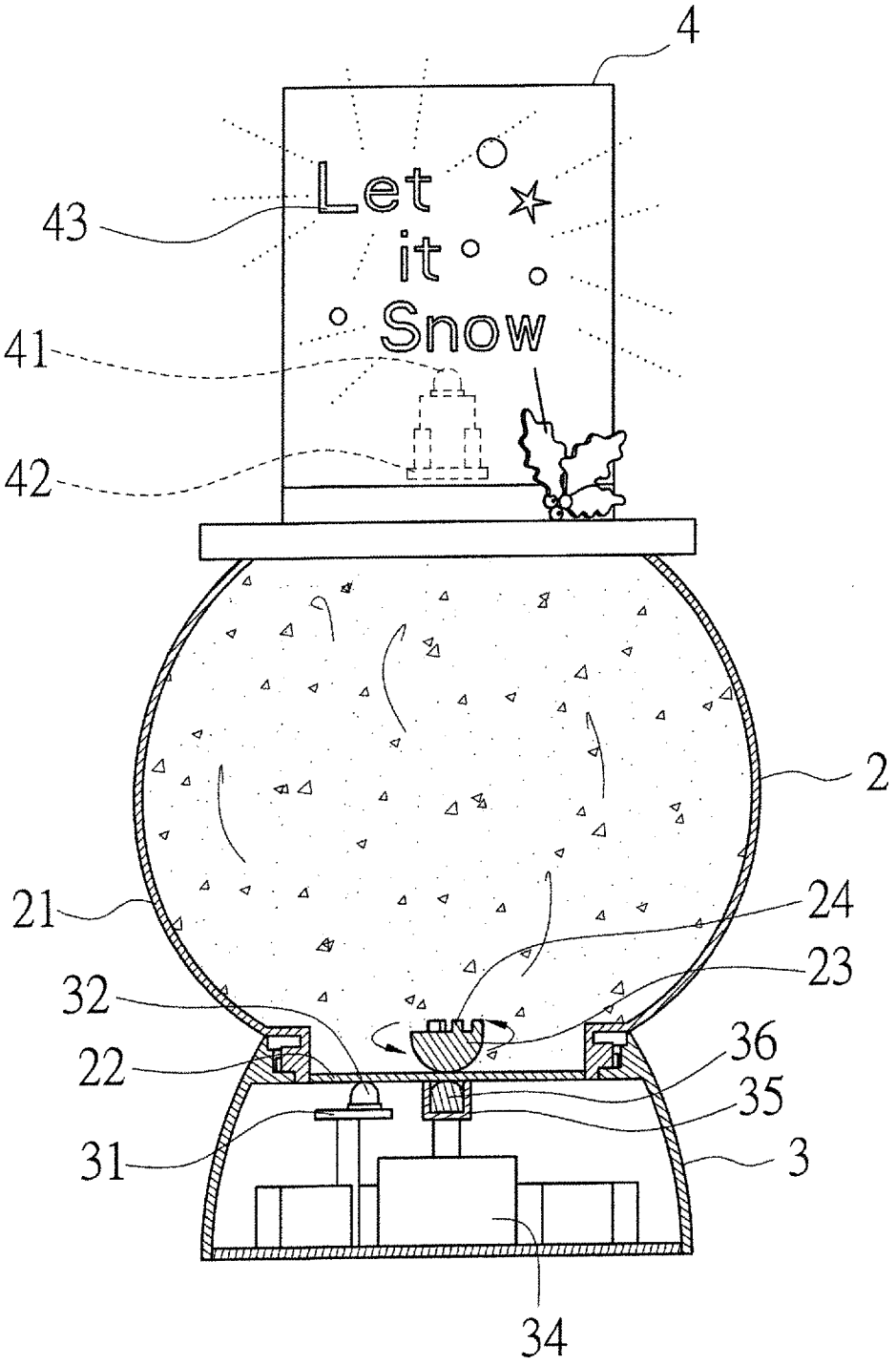
FIG. 6 is a cross-sectional view of FIG. 5.

Referring to FIGS. 5 and 6, the base seat 3 has a magnetic rotating shaft 35 driven by a power member 34 to rotate, where the power member 34 is a motor in the present embodiment, and the magnetic rotating shaft 35 is extended from the motor. Furthermore, a magnetic element 36 is configured on the top end of the magnetic rotating shaft 35, and the electric force of the power element 34 may be supplied by a corresponding assembled battery, AC power source or DC power source; there are various other electric power sources, but they are not the claiming features within the claims of the present invention, and therefore the details thereof are omitted here.

A hemispherical poking member 23, which is attracted magnetically by and rotated with the magnetic rotating shaft 35, is configured inside the main body 2, and a plurality of radiating poking plates 24 are configured on the top of the poking member 23.

Furthermore, customized patterns 43 are put on the surface of the top decoration 4 of the present invention, and the forming technologies of the customization patterns 43, for example, may be formed with hollow portions on the wall face of the top decoration 4, allowing the internal light to emit directly out thereof, thereby forming different brightness from the surrounding foggy wall face, or lighttight paint is spread on the places of the surface of the top decoration 4 where no patterns are configured, allowing the internal light to transmit out of the customization patterns 43 only. The forming technologies of the customization patterns 43 are rather too many and not described one by one here.

Thereupon, the magnetic rotating shaft 35 is driven to rotate, and the poking member 23 is attracted magnetically by the magnetic rotating shaft 35 to rotate therewith, and at the same time the fluid inside the main body 2 is stirred by the poking plates 24 when the switch 33 is switched on to provide electric conduction between the power member 34 and the power source. In addition, the customization patterns 43 allows the present invention to form a customization water lamp with an extremely personal feature when the light-emitting elements 41 inside the top decoration 4 is glistened and the colors thereof are changed, enabling the present invention to achieve various visual effects together with the cross effects of the rotational flowing of the fluid and the projection of light.

I claim:

1. A water lamp with a top decoration, comprising:

a main body, assuming a hollow, pervious-to-light three-dimensional modeling, slightly-thick flowable low-boiling-point fluid being filled hermetically and a poking member being configured inside said main body;

a base seat, configured below said main body, a control circuit and at least one light-emitting element in electric connection with said control circuit being configured on said base seat correspondingly to a bottom of said main body and said base seat having a magnetic rotating shaft driven by a power member to rotate, said magnetic rotating shaft attracting said poking member magnetically to rotate; and a top decoration, assuming a foggy, pervious-to-light, three-dimensional modeling, coupled to a upper side of said main body, and a light-emitting element in electric connection with said control circuit being configured inside said top decoration.

2. The water lamp according to claim 1, wherein a surface of said top decoration has a customized pattern.

3. The water lamp according to claim 1, wherein a switch in electric connection with said control circuit is configured on said base seat.

* * * * *